US005791238A

United States Patent [19]

Garbotz

[11] Patent Number: 5,791,238

[45] Date of Patent: Aug. 11, 1998

[54] LOOPING STRAP TENSIONING DEVICE

[75] Inventor: Uwe Garbotz, Bayreuth, Germany

[73] Assignee: SMB Schwede Maschinenbau GmbH, Germany

[21] Appl. No.: 785,129

[22] Filed: Jan. 22, 1997

[30] Foreign Application Priority Data

Jan. 25, 1996 [DE] Germany ..... 196 02 579.6

[51] Int. Cl.[6] ..... B65B 13/22

[52] U.S. Cl. ..... 100/32; 53/589

[58] Field of Search ..... 100/1, 8, 25, 26, 100/29, 32, 33 PB; 53/589

[56] References Cited

U.S. PATENT DOCUMENTS 4,387,631 6/1983 Pasic .
5,078,058 1/1992 Schwede et al. .

FOREIGN PATENT DOCUMENTS 2247594 4/1973 Germany .
2700533 7/1977 Germany .

*Primary Examiner*—Stephen F. Gerrity
*Attorney, Agent, or Firm*—Laff, Whitesel, Conte & Saret, Ltd.

[57] ABSTRACT

A tensioning device for tautening a looping strap around a product stack is provided with a stationary clamping arrangement, which comprises a controllable clamping lever and an opposite clamping bearing, with a pivotable tension lever, with deflecting rolls for tensioning the strap in the way of a pulley block, with a pivotable rocker lever, which comprises a control ramp and is adjustable in dependence on the height of the product stack, and with a control lever, to be actuated by the control ramp, for the clamping lever, the control lever being pivotably articulated to the tension lever and controlling the clamping lever in accordance with the position, dependent on the stack height, of the control ramp in such a way that when the stack height decreases, the blocking of the clamping arrangement is increasingly retarded and the tensioning length of the looping strap is reduced.

7 Claims, 6 Drawing Sheets

LOOPING STRAP TENSIONING DEVICE

BACKGROUND OF THE INVENTION

1. Field of the Invention

The invention relates to a tensioning device for a looping strap which is used in a looping machine for the bundling of product stacks such as stacks of newspapers or for the tying up of a box.

2. Background Art

In a looping machine, the looping strap is usually loosely slung around the product stack by means of a strap guidance, it is then pulled back to fit tightly around the product stack, after which the looping strap is tautened by means of a tensioning device. As a rule, the leading end of the looping strap is held in the welding head of the machine, the looping strap is seized by the tensioning device and pulled taut over a certain length against the sense of insertion.

Tensioning devices of various designs are known. For instance, U.S. Pat. No. 5,078,058 teaches a tensioning device which has a driver disk that is motor-driven about an axis of rotation and features a support surface for the strap. Clamping elements are allocated to the driver disk, each having a clamping surface. A guide element is provided for the clamping elements, by means of which the clamping elements can be moved into a certain position in a closing area that is smaller than the angle of strap contact on the support surface; in this position the strap is held non-positively between the clamping surfaces and the supporting surface. This tensioning device is constructionally complicated.

Furthermore, tensioning devices are known, in which the strap is seized by a clamping device which has a clamping lever to be controlled between a blocking position and a position of release and an opposite clamping bearing. A pivoting tension lever is provided with a deflecting element, over which the looping strap is guided when the tension lever is pivoted in the sense of tensioning in the way of a pulley block. This tensioning principle, the so-called "double tensioning", helps achieve high tensioning lengths.

Special problems are posed in connection with the tensioning forces attainable. The looping strap must keep the product stack tightly together, however tensioning must be the more pronounced the softer, i.e. the more compressible, the product is that constitutes the stack. As a rule, the compressibility of a stack grows with the latter's height and number of products stacked, for instance magazines. This means that high tensioning must be ensured for a high stack, whereas there must be virtually no more tensioning in the case of very low stacks or when single products are looped, since too high a tensioning would cause the magazine to roll up.

Fundamentally, tensioning depending on the height of a stack has been known. In this case, a rocker lever is allocated to a tensioning device that comprises a tension lever with a clamping arrangement directly attached to the latter's pivoting end, the pivoting position of the rocker lever depending on the height of a stack. A clamping lever of the clamping arrangement is directed between a position of blocking and a position of release by way of the rocker lever, blocking taking place the later the lower the height of a stack that is detected by touch contact.

Drawbacks of this known construction reside in the fact that tensioning depending on the height of the stack is attainable, but can take place only over a limited length because of the simple design of the clamp.

SUMMARY OF THE INVENTION

It is the object of the invention to embody a tensioning device which allows tensioning depending on the height of a stack, while nevertheless ensuring a high tensioning length.

This object is attained in a tensioning device comprising a stationary clamping arrangement for fixing the looping strap, which has a clamping lever to be directed between a position of blocking and a position of release and an opposite clamping bearing; a pivotable tension lever having a deflecting element, along which the looping strap is guided in the way of a pulley block when the tension lever is pivoted in the sense of tensioning; a pivotable rocker lever, which has a control ramp and which is adjustable by way of a touch contact arrangement in dependence on the height of the product stack; and a control lever, to be actuated by the control ramp, for the clamping lever, the control lever being pivotably articulated to the tension lever and, in accordance with the position, depending on the stack height, of the control ramp, directing the clamping lever into the latter's position of blocking or release in such a way that when the stack height decreases, the blocking of the clamping arrangement is increasingly retarded and the tensioning length of the looping strap is reduced. The invention is based on a combination of the known principles of tensioning in dependence on the height of a stack on the one hand and of so-called "double tensioning" on the other. It is the gist of the invention to couple these two principles constructionally, which is attained by a control lever for the clamping lever of the clamping arrangement, the control lever being actuated by the control ramp of the rocker lever. The control lever is pivotably articulated to the tension lever and, during the tensioning motion of the tension lever, controls the clamping lever of the stationary clamping arrangement in accordance with the position of the control ramp that depends on the height of a stack in such a way that with the height of a stack decreasing, blocking of the clamping arrangement is increasingly retarded and the tensioning length of the looping strap is reduced.

Preferred designs, further features, details and advantages of the invention will become apparent from the subclaims and the ensuing description of an exemplary embodiment, taken in conjunction with the drawing.

DESCRIPTION OF THE PREFERRED EMBODIMENT

Figure 1:
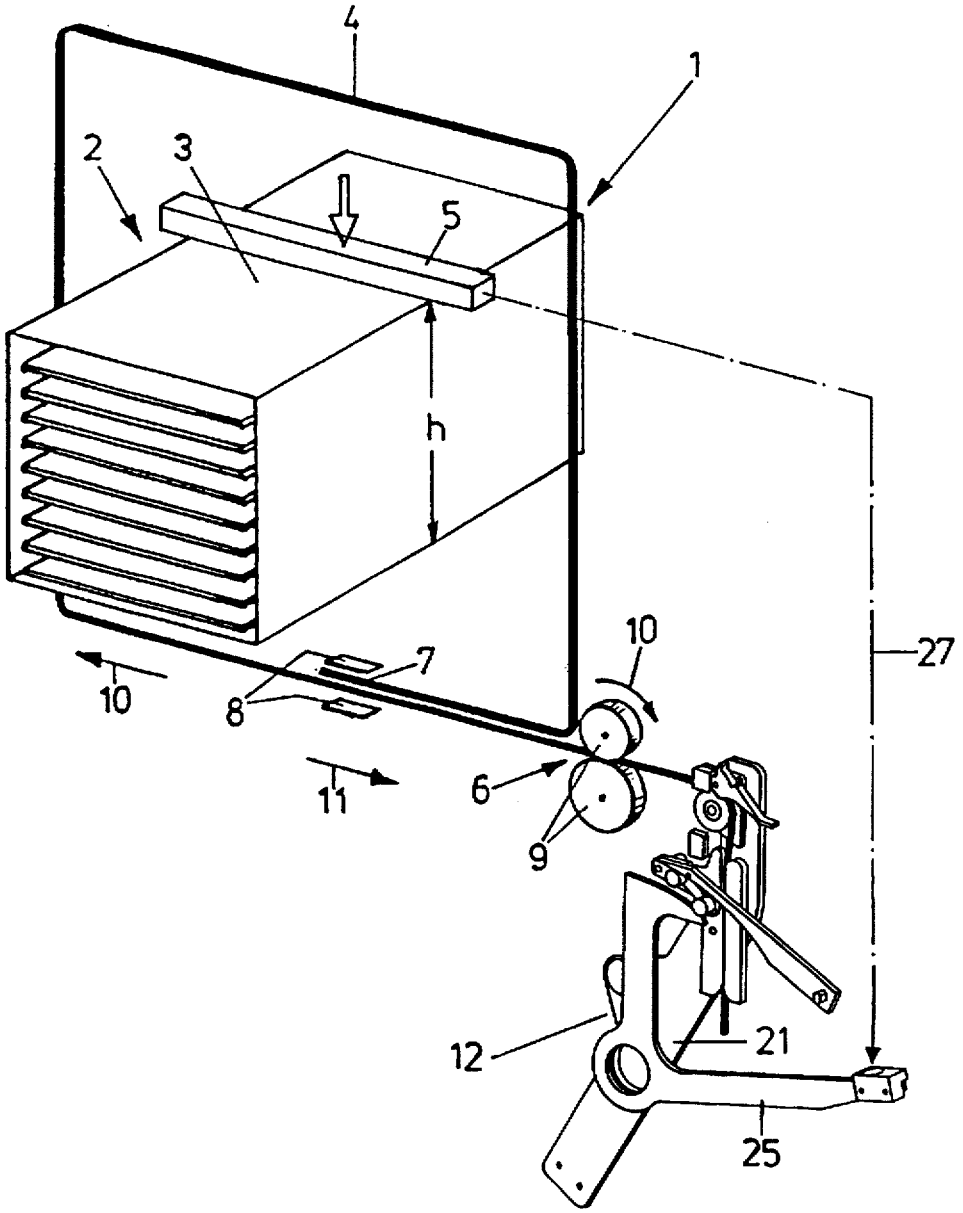
FIG. 1 is a perspective diagrammatic illustration of a looping machine comprising a strap tensioning device according to the invention.
Figure 2:
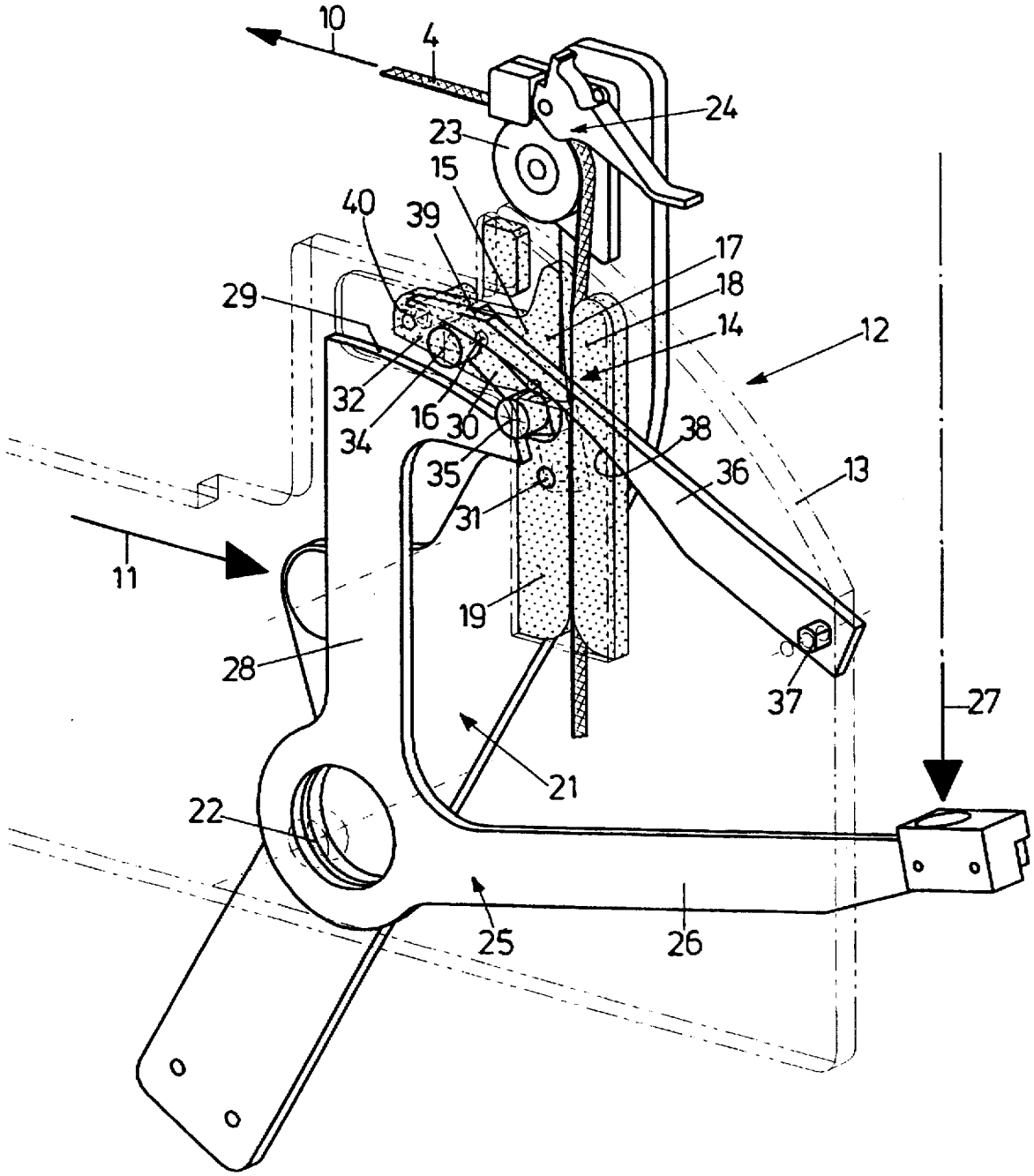
FIG. 2 is a perspective view of the strap tensioning device according to FIG. 1, and FIGS. 3 to 6 are lateral views of the tensioning device in various operating positions.

As seen in FIG. 1, in a looping machine 1, a product stack 2, for instance a stack of newspapers possibly in a wrapping 3, is enveloped by a looping strap 4. This is drawn off a supply (not shown) and inserted into the looping machine 1 by means of a so-called insertion device 6, loosely looping the product stack 2. In the looping machine 1, the free end 7 of the looping strap 4 is seized and held by a clamp 8. The insertion device 6 consists of a pair of rolls 9 to be driven at a high speed and a drive motor not shown in the drawing. By reversing the sense of rotation of the pair of rolls 9, the looping strap 4, the free end 7 of which is held by the clamp 8 in the looping machine 1, is retracted against the sense of insertion 10 and in the sense of tensioning sufficiently far for it to fit tightly around the product stack 2. Simultaneously, a pressing beam 5 moves at a defined force from above onto the product stack 2 and aids in the latter being compressed and stably looped. A looping machine 1 of this type comprising an insertion device 6 for a looping strap 4, a clamp 8 and deflection devices (not shown in the drawing) in the form of a guidance for the strap 4, by means of which the strap is guided around the product stack 2, is generally known and widely spread in practice.

For the looping strap 4 slung around the product stack 2 to be pulled taut, a tensioning device 12 is provided, as seen in detail in FIGS. 2 to 6.

This tensioning device 12 comprises a stationary clamping arrangement 14, which is disposed on a machine frame member 13 and serves to fix the looping strap 4 during a tensioning operation. The clamping arrangement 14 has a double-armed clamping lever 15, which is supported on the machine frame member 13 pivotably about a pivot bearing 16. The hammer-type clamping head 17 is faced by an opposite clamping bearing 18 stationary on the machine frame, which is elongated in the vertical direction to form a strap guide. Disposed below the clamping head 17 is another guide member 19 which is stationary on the frame and between the upper side of which and the clamping head 17 is clamped a helical compression spring 20 for actuation of the clamping lever 15 in the clamping and locking direction K.

A tension lever 21 pivotably supported on the machine frame 13 extends by the side of the clamping arrangement 14; the tension lever 21 rotatably supports a deflecting roll 23 on its free end opposite to the pivot bearing 22, the deflecting roll 23 cooperating with a tiltable deflecting guide 24. The deflecting roll 23 and the deflecting guide 24 are known from the prior art and need no detailed explanation as regards their design and function. The tension lever 21 is pivotable in the sense of tensioning 11 by means of a drive (not shown) for the tensioning operation, which will still be explained in detail.

A rocker lever 25 in the form of a double-armed angle lever is pivotably lodged in the pivot bearing 22 of the tension lever 21 and has a coupling arm 26 extending substantially horizontally. By way of this coupling arm 26, the rocker lever 25 is coupled with a touch contact arrangement 27 in the form of an appropriate rod assembly, which is only symbolically outlined by a dot-dashed arrow and which transmits the position of the pressing beam 5 to the rocker lever 25. As a result, the pivoting angle position of the rocker lever 25 can be adjusted in dependence on the height h (FIG. 1) of the compressed product stack 2.

The free end of the vertical support arm 28 of the rocker lever 25 is provided with a control ramp in the form of an arched support curve 29 which actuates a control lever 30. The latter is a single-armed, obtuse-angled elbow lever lodged in a pivot bearing 31 on the tension lever 21. In the vicinity of its free end 32 and of its apex 33, the control lever 30 has stop pins 34, 35 projecting laterally, of which the stop pin 35 located at the apex 33 cooperates with the support curve 29 on the rocker lever 25 and of which the stop pin 34 located in the vicinity of the free end 32 cooperates with another transmission lever 36. The latter is a single-armed, straight lever, which is by far longer as compared with the control lever 30 and the clamping lever 15 and which is lodged in a pivot bearing 37 on the machine frame member 13. The transmission lever 36 runs at right angles to the tension lever 21, it being noted that all the levers 15, 21, 25, 30 and 36 can be pivoted on planes parallel to each other. The transmission lever 36 further comprises a contact curve 38 which, in the position of release, is parallel to the support curve 29 on the rocker lever 25 and extends at a distance therefrom and along which can slide the stop pin 34 at the free end of the control lever 30. By its upper side 39 turned away from the contact curve 38, the transmission lever 36 acts on the arm 40, turned away from the clamping head 17, of the clamping lever 15.

In the following, the functioning of the strap tensioning device according to the invention is explained in detail.

Figure 3:
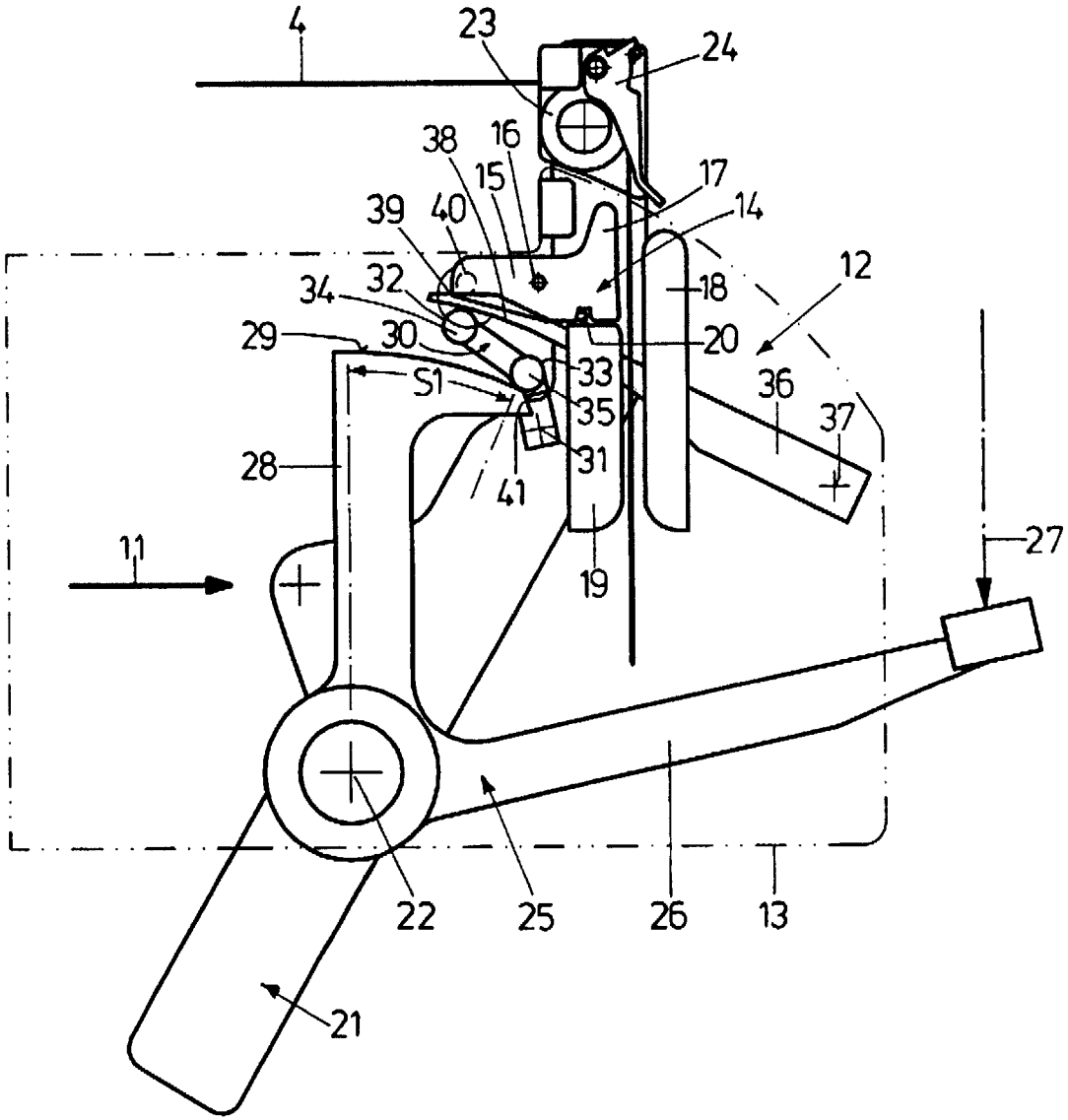
Figure 4:
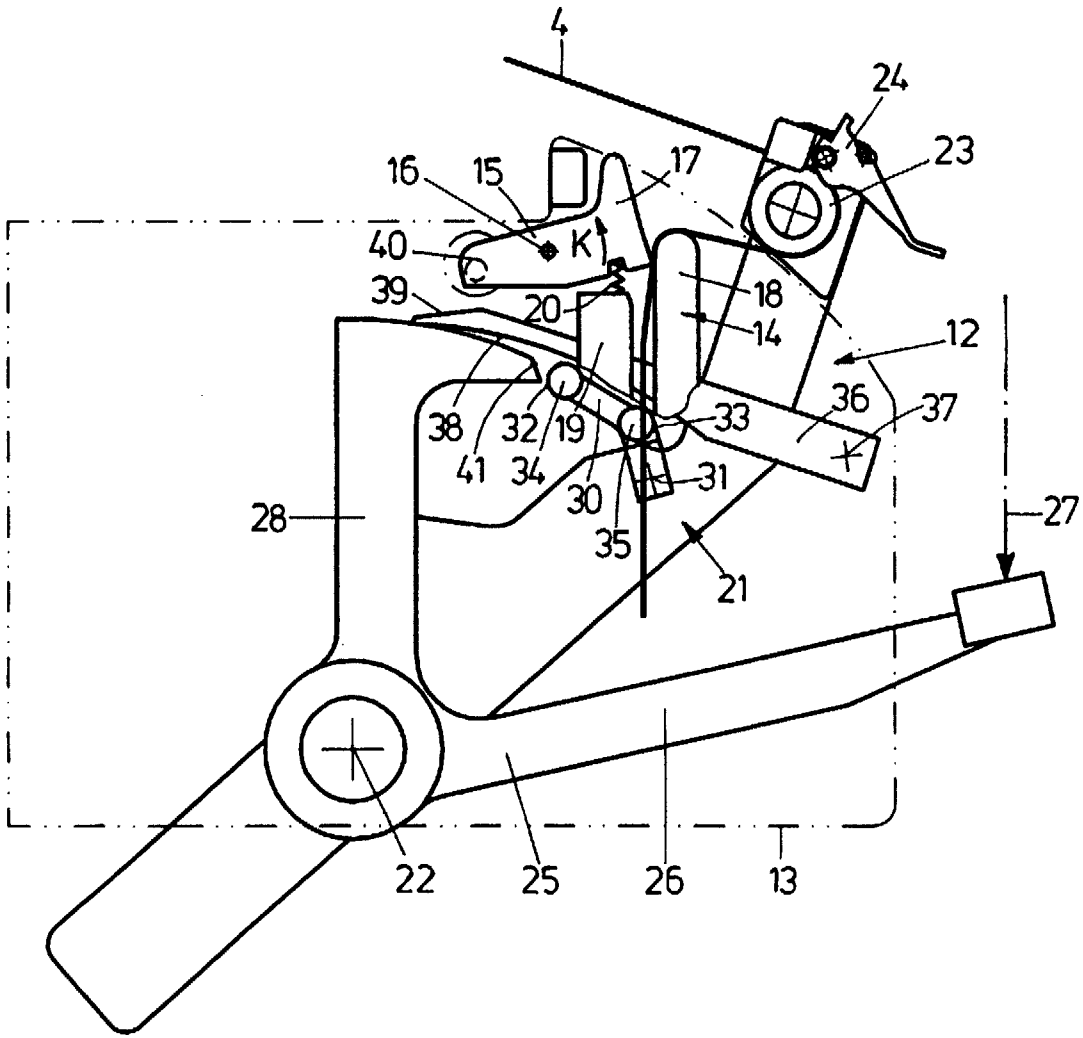

FIGS. 3 and 4 illustrate the sequence of operations in strap tensioning with a high product stack. After insertion of the looping strap 4 via a strap guidance, part of which is formed by the clamping head 17, the opposite clamping bearing 18, which is prolonged downwardly, and the guide member 19 as well as the gap formed between the deflecting roll 23 and the deflecting guide 24, the looping strap 4 is fitted around the product stack 2 in the way described at the outset by the aid of the pair of rolls 9. The product stack 2 is to be comparatively high for the sequence of functions illustrated in FIGS. 3 and 4 so that, conditioned by the touch contact arrangement 27, the rocker lever 25 is in a pivoting position virtually not deflected clockwise out of its initial position (FIG. 3). With the tension lever 21 not operated, the stop pin 35 of the control lever 30 rests on the support curve 29, thus being pivoted clockwise. As a result, the transmission lever 36 is equally pivoted clockwise by the aid of the stop pin 34 at the free end 32 of the control lever 30, its upper side 39 acting on the clamping lever 15 against the force of the compression spring 20. Consequently, the clamping arrangement 14 is in its released position.

As soon as the tension lever 21 is pivoted out of the position of FIG. 3 and clockwise to the right by a small pivoting angle S1, the stop pin 35 slides off the end of the support curve 29, the control lever 30, the transmission lever 36 and the clamping lever 15 thereby pivoting counterclockwise under the action of the compression spring 20 and the clamping arrangement 14 being closed (FIG. 4). The clamping head 17 wedges the looping strap 4 towards the opposite clamping bearing 18 so that further pivoting of the tension lever 21 will result in high tensioning force being exercised on the looping strap 4. In the first place, this is due to the fact that the deflecting roll 23 helps obtain virtually twice the tensioning length as compared with the pivoting path of the tension lever 21, since the looping strap is guided over the deflecting roll 23 virtually in the way of a pulley block.

After welding of the looping strap 4 for it to be fixed around the product stack 2 in the tensioned condition, the tension lever 21 is pivoted back counterclockwise so that the stop pins 34, 35 disposed at the free end 32 and the apex 33 of the control lever 30 one after the other climb a slope 41 onto the support curve 29, thus moving the transmission lever 36 and the clamping lever 15 back into the opened condition against the force of the compression spring 20 (FIG. 3).

Figure 5:
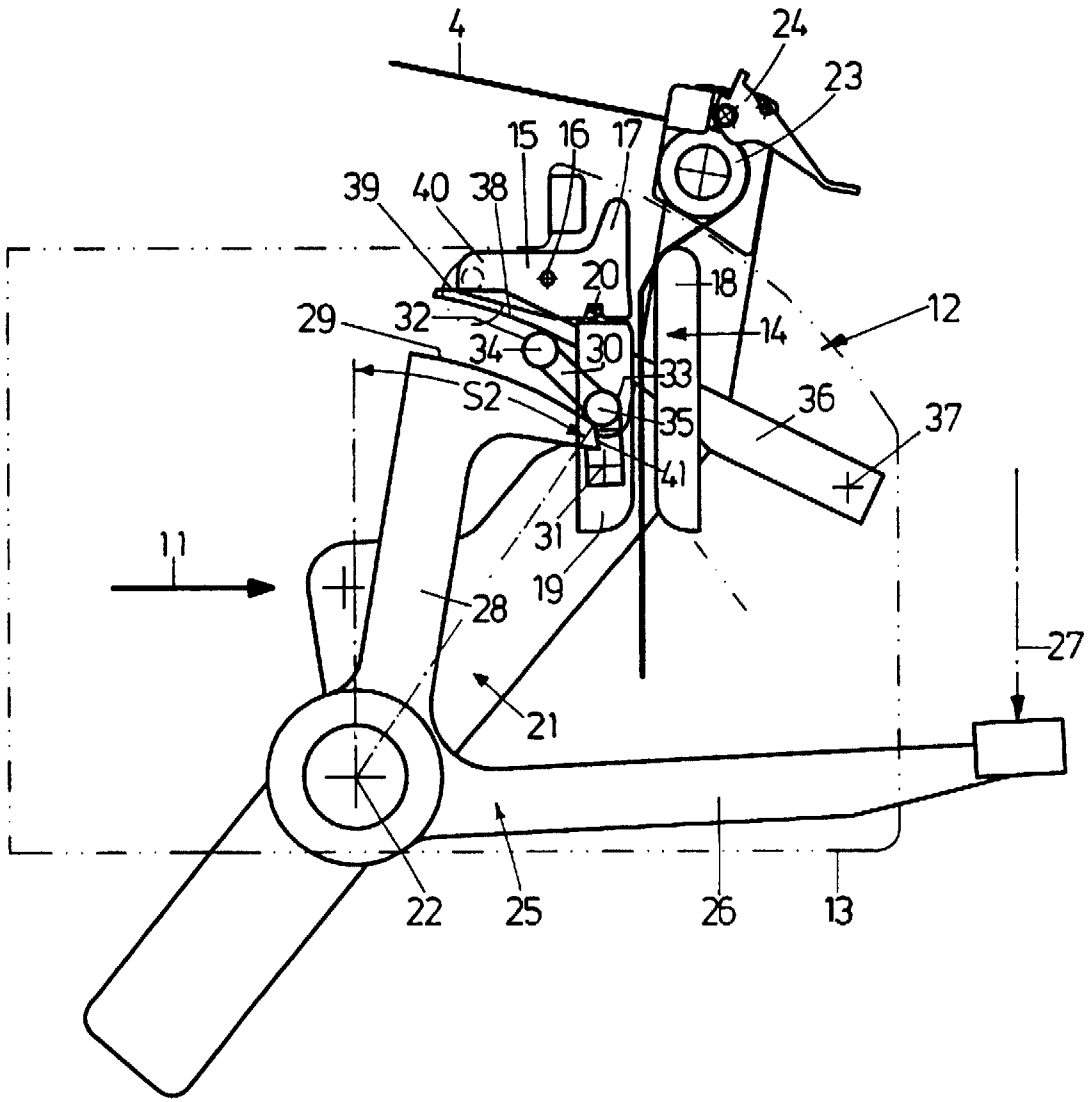
Figure 6:
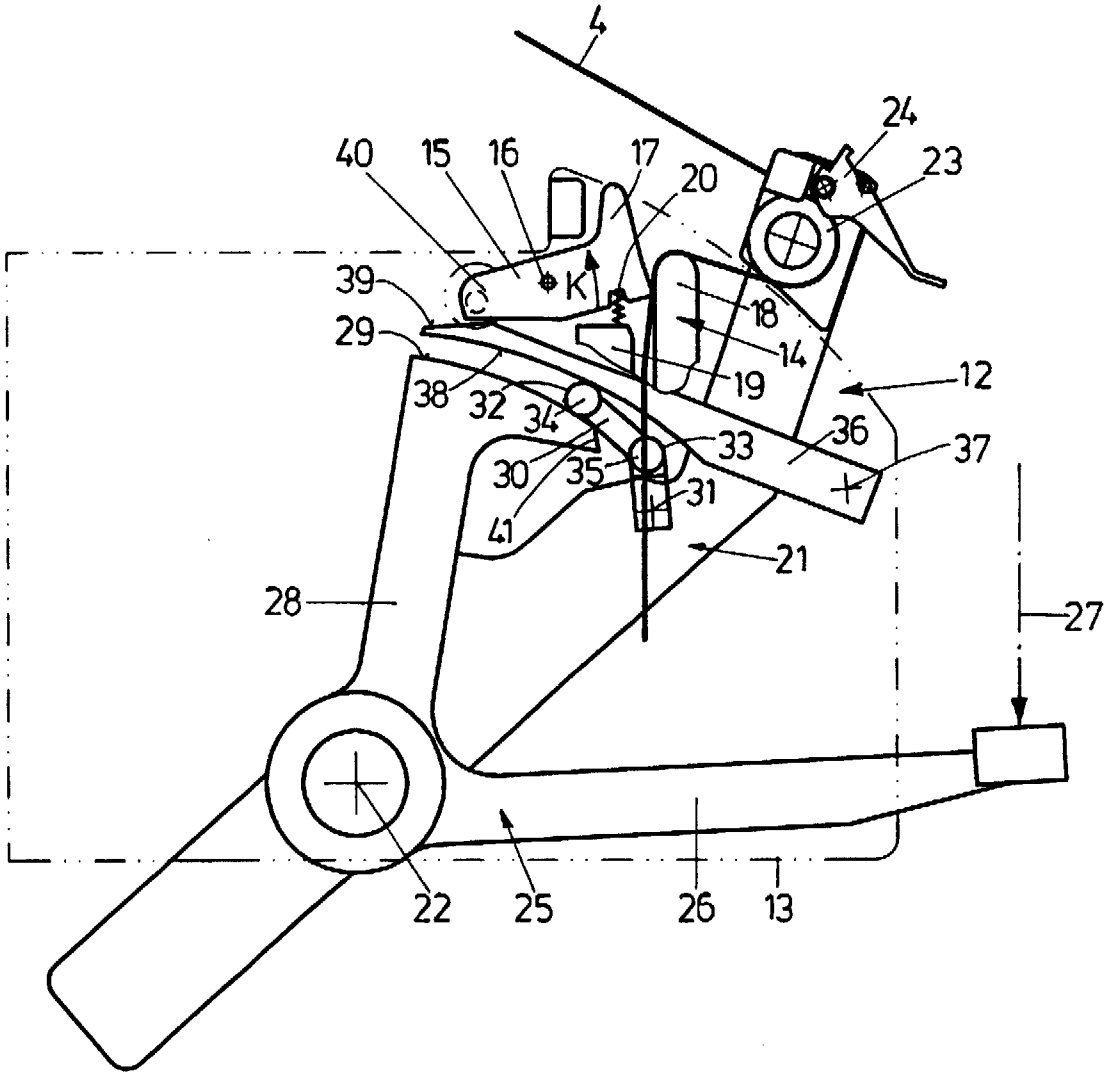

Strap tensioning in dependence on the height of the stack will become apparent from FIGS. 5 and 6. Only a very low product stack is to be looped. Consequently, the pressing beam 5 of the looping machine 1 moves further downward during the pressing job, thus further clockwise pivoting the rocker lever 25 via the touch contact arrangement 27. This means that the support curve 29 supports the control lever 30 for a greater pivoting angle of the tension lever 21, thus keeping open the clamping arrangement 14 through a greater pivoting angle S2 of the tension lever 21 as compared with S1. It is only at a later moment during the tension motion of the tension lever 21 that the stop pin 34 of the control lever 30 will slide off the support curve 29 because of the modified position of the rocker lever 25 and release the clamping lever 15 in the direction of blocking. In this regard, tensioning of the looping strap 4 is obtained only through a very short pivoting angle.

Since the blocking of the clamping arrangement 14 is increasingly retarded when the stack height h decreases and, consequently, the deflection of the support curve 29 increases, the tensioning length of the looping strap 4 is successively reduced.

What is claimed is:

1. A tensioning device for a looping strap (4) which, in a looping machine (1), is loosely slung around a product stack (2), then fitted tightly around the product stack (2) and finally pulled taut by means of the tensioning device (12), comprising a stationary clamping arrangement (14) for fixing the looping strap (4), which has a clamping lever (15) to be directed between a position of blocking and a position of release and an opposite clamping bearing (18), a pivotable tension lever (21) having a deflecting element (23), along which the looping strap (4) is guided in the way of a pulley block when the tension lever (21) is pivoted in the sense of tensioning, a pivotable rocker lever (25) which has a control ramp (29) and which is adjustable by way of a touch contact arrangement (27) in dependence on a height (h) of the product stack (2), and a control lever (30), to be actuated by the control ramp (29), for the clamping lever (15), the control lever (30) being pivotably articulated to the tension lever (21) and, in accordance with a position, depending on the stack height (h), of the control ramp (29), directing the clamping lever (15) into the latter's position of blocking or release in such a way that when the stack height (h) decreases, a blocking of the clamping arrangement (14) is increasingly retarded and a tensioning length of the looping strap (4) is reduced.

2. A tensioning device according to claim 1, wherein the rocker lever (25) is a double-armed angle lever, one arm of which is a coupling arm (26) to be actuated by the touch contact arrangement (27) and the other arm (28) of which comprises the control ramp (29) in the form of an arched support curve (29), on which the control lever (30) supports itself through a pivoting angle (S1, S2), depending on the stack height (h), of the tension lever (21), while keeping the clamping arrangement (14) released.

3. A tensioning device according to claim 1, wherein a transmission lever (36) is placed in between the control lever (30) and the clamping lever (15), a lever arm of the transmission lever (36) being substantially longer than that of the control and clamping levers (30, 15).

4. A tensioning device according to claim 3, wherein the clamping lever (15), the transmission lever (36) and the control lever (30) are pivotable in the same direction and on planes parallel to each other.

5. A tensioning device according to claim 3, wherein the clamping lever (15), when in a position of release from the transmission lever (36) and the control lever (30), can be actuated against the force of a compression spring (20).

6. A tensioning device according to claim 3, wherein the transmission lever (36) has a contact curve (38) which is parallel to the control ramp (29) on the rocker lever (25) in the position of release, the control lever (30), during its pivoting motion together with the tension lever (21), being guided by two stop elements (34, 35) along the control ramp (29) and the contact curve (38), respectively, in the position of release.

7. A tensioning device according to claim 6, wherein the control lever (30) is a single-armed obtuse-angled elbow lever, which has one of the stop elements (34, 35) at a time in the vicinity of its free end (32) and of its apex (33).

* * * * *